US007061447B1

(12) United States Patent
Bozler et al.

(10) Patent No.: US 7,061,447 B1
(45) Date of Patent: Jun. 13, 2006

(54) RECONFIGURABLE ANTENNAS USING MICROELECTROMECHANICAL (MEMS) SHUTTERS AND METHODS TO UTILIZE SUCH

(75) Inventors: Carl O. Bozler, Waltham, MA (US); Mark A. Gouker, Lexington, MA (US); Sean M. Duffy, Newton, MA (US)

(73) Assignee: The United States of America as represented by the Secretary of the Air Force., Washington, DC (US)

( * ) Notice: Subject to any disclaimer, the term of this patent is extended or adjusted under 35 U.S.C. 154(b) by 0 days.

(21) Appl. No.: 10/911,762

(22) Filed: Aug. 2, 2004

(51) Int. Cl.
*H01Q 15/02* (2006.01)

(52) U.S. Cl. ..... 343/910; 343/753

(58) Field of Classification Search ..... 343/753, 343/910

See application file for complete search history.

(56) References Cited

U.S. PATENT DOCUMENTS

| | | | | |
|---|---|---|---|---|
| 5,389,944 | A | 2/1995 | Collinge | |
| 5,455,589 | A | 10/1995 | Huguenin | |
| 5,606,334 | A | 2/1997 | Amarillas | |
| 5,670,965 | A | 9/1997 | Tuovinen | |
| 5,680,139 | A | 10/1997 | Huguenin | |
| 6,127,908 | A * | 10/2000 | Bozler et al. | 333/246 |
| 6,281,852 | B1 | 8/2001 | Amarillas | |
| 6,473,049 | B1 * | 10/2002 | Takeuchi et al. | 343/753 |
| 6,509,875 | B1 * | 1/2003 | Nair et al. | 343/700 MS |
| 6,621,459 | B1 * | 9/2003 | Webb et al. | 343/754 |
| 6,686,885 | B1 * | 2/2004 | Barkdoll et al. | 343/700 MS |
| 6,753,815 | B1 * | 6/2004 | Okubora et al. | 343/700 MS |
| 6,864,848 | B1 * | 3/2005 | Sievenpiper | 343/767 |
| 6,930,653 | B1 * | 8/2005 | Rawnick et al. | 343/912 |

* cited by examiner

*Primary Examiner*—Tho Phan
(74) *Attorney, Agent, or Firm*—William G. Auton

(57) ABSTRACT

A reconfigurable antenna is presented that uses MEMs shutters to reconfigure a Fresnel zone plate antenna. It can be used to either point a main beam in different directions or to point multiple beams in different directions.

2 Claims, 9 Drawing Sheets

(FRONT VIEW)
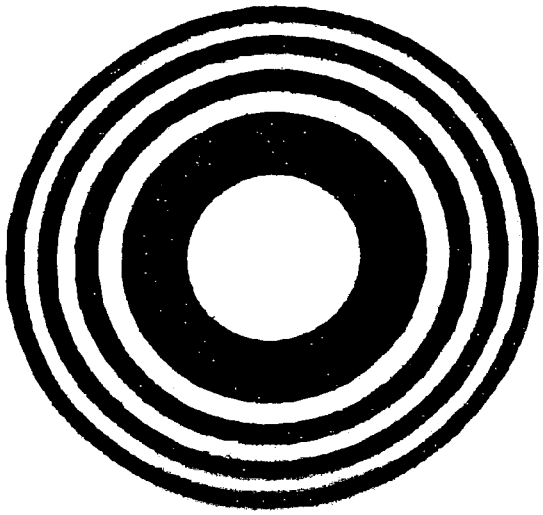
FIG. 1A
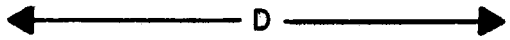
FIG. 1B
(SIDE VIEW)
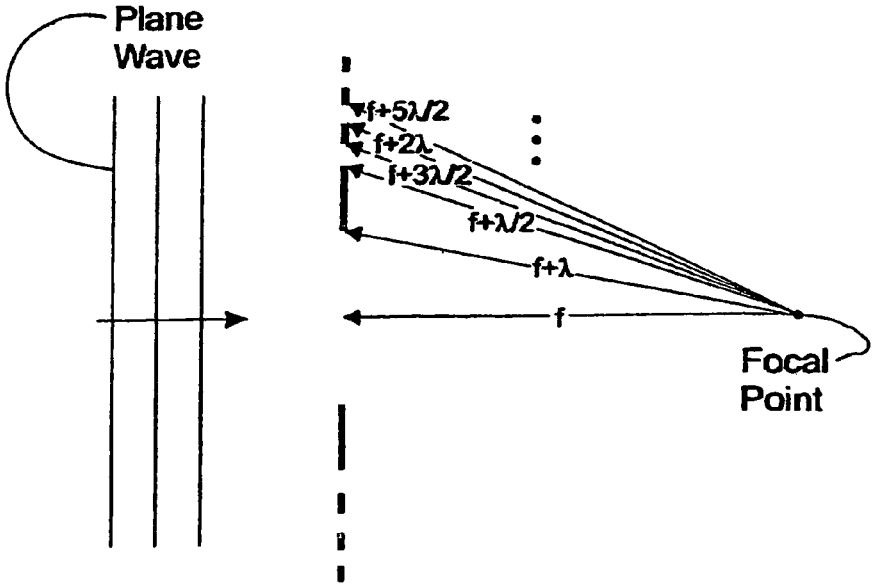

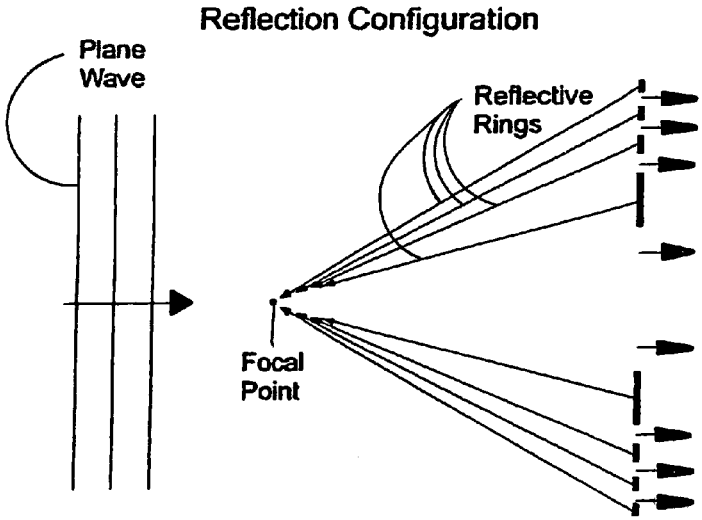
FIG. 2A
FIG. 2B
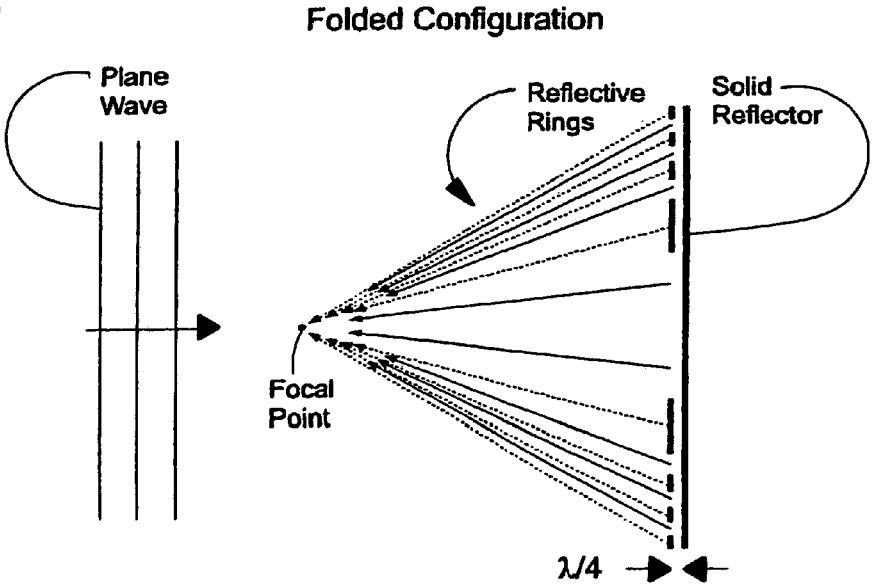

RECONFIGURABLE ANTENNAS USING MICROELECTROMECHANICAL (MEMS) SHUTTERS AND METHODS TO UTILIZE SUCH

STATEMENT OF GOVERNMENT INTEREST

The invention described herein may be manufactured and used by or for the Government for Governmental purposes without the payment of any royalty thereon.

BACKGROUND OF THE INVENTION

The present invention generally relates to antennas and more specifically to three related, but distinct ideas. Two are classes of reconfigurable antennas constructed with the aid of MEMs shutters. The first class is the Fresnel zone plate antenna, which can be electronically reconfigured to point the main beam over a useful range of pointing directions. The second class is integrated circuit antennas constructed on dielectric substrates, such as the microstrip patch antenna and printed dipole antenna, which can be electronically reconfigured to operate over very wide bandwidths, either as isolated elements or in an array. The third idea is a technique to form multiple beams complete with null formation capability from a zone plate or reflect-array antenna.

Fresnel zone plate antennas are shown in the following U.S. Patents, the disclosures of which are incorporated herein by reference.

U.S. Pat. No. 6,621,459, Sep. 16, 2003, Plasma controlled antenna, Webb, George

U.S. Pat. No. 6,473,049, Oct. 29, 2002, Antenna device, Takeuchi

U.S. Pat. No. 6,281,852, Aug. 28, 2001, Integrated antenna for satellite and terrestrial broadcast reception, Amarillas U.S. Pat. No. 5,680,139, Oct. 21, 1997, Compact microwave and millimeter wave radar, Huguenin U.S. Pat. No. 5,670,965, Sep. 23, 1997, Compact antenna test range, Tuovinen U.S. Pat. No. 5,606,334, Feb. 25, 1997, Integrated antenna for satellite and terrestrial broadcast reception, Amarillas U.S. Pat. No. 5,455,589, Oct. 3, 1995, Compact microwave and millimeter wave radar, Huguenin U.S. Pat. No. 5,389,944, Feb. 14, 1995, Phase correcting reflection zone plate for focusing microwave, Collinge Applications of MEMs technology constitute a number of recent innovations such as the system of U.S. Pat. No. 6,127,908, which is incorporated herein by reference for use with the present invention.

U.S. Pat. No. 6,127,908 is entitled Microelectro-mechanical system actuator device and reconfigurable circuits utilizing same, by Bozler, Carl.

This cited patent discloses a micro-electro mechanical device which includes a fixed electrode formed on a substrate, the fixed electrode including a transparent, high resistance layer, and a moveable electrode formed with an anisotrophic stress in a predetermined direction and disposed adjacent the fixed electrode. The device includes first and second naturally conductive regions, which are isolated from one another by the fixed electrode. The moveable electrode moves to cover the fixed electrode and to electronically couple to the second conductive region, thus electrically coupling the first and second conductive regions, in response to a potential being applied across the fixed and moveable electrodes.

The fixed electrode is apparent to electromagnetic signals or waves and the moveable electrode impedes or allows transmission of electromagnetic signals or waves. In one embodiment of the invention, the fixed and moveable electrodes are configured within an array of similar devices, and each device or groups of devices in the array are individually addressable to actuate the moveable electrodes. In another embodiment of the invention, there is provided a reconfigurable circuit including an array of actuatable devices which are addressed individually or in selected groups, each of the actuatable devices having a fixed electrode formed on a substrate, the fixed electrode including a transparent, high resistance layer, and a moveable electrode formed with an anisotropic stress in a predetermined direction and disposed adjacent the fixed electrode.

SUMMARY OF THE INVENTION

The present invention makes the main beam from the zone plate antenna able to scan electronically over a useful range of directions. The advancement over previous devices comes from the incorporation of the MEMs shutter arrays—MEMS shutter arrays made with integrated circuit fabrication techniques or other means that result in similarly activated devices. The reconfigurable zone plate described therein may have other uses beyond zone plate antennas in other regions of the spectrum, for example, as an optical element capable of redirecting the path of an optical beam.

The zone plate can be used in the microwave and millimeter wave regions of the spectrum as well. Further it can be adapted for use as an aperture antenna. The zone plate is a quasi-optical element just as lenses and reflectors in the microwave and millimeter wave region, and it can be used to construct lens and reflector antennas. A feed antenna can be placed at the focal point of the zone plate to form a prime focus antenna, or subreflectors can be used to form center fed or off axis designs.

A second embodiment of the reconfigurable zone plate is to re-write the zone place rings to form multiple beams. This is achieved by allocating a portion of the MEMS shutter array to each of the desired beams. The ring pattern in this region of the array is the same as if the entire array were designed to produce a beam in the desired direction. Further, the phase of the various beams can be adjusted to produce desirable effects as the multiple beams are superimposed in the far field. For example, a difference pattern can be formed from a standard zone plate ring configuration by simply reversing tone (open for blocked and blocked for open) of the rings on one-half of the array. By alternating between a difference pattern in the azimuth plane, difference pattern in the elevation plane and a sum ("normal") pattern and by correctly processing the received signals, one can form a psuedo mono pulse antenna function. Other advantageous antenna functions can be similarly realized as described below. The third embodiment involves reconfiguration of the elements in an array. Here, not only are the array elements adjusted, but the constrained feed system from the microwave generator to the antenna elements is adjusted.

There and other advantages, objects and features of the invention which will become more apparent after considering the following description taken in conjunction with the illustrative embodiment in the accompanying drawings.

DESCRIPTION OF THE DRAWINGS

FIGS. 1*a* and 1*b* are diagrams of the front and side views of a Fresnel zone plate, transmission configuration. The ring pattern is designed by simple geometry. Using Huygen's principle the incident plane wave is replaced by point sources in the zone plate aperture. The regions in the aperture whose point sources produce a wave at the focal point with phase between, say, 0 and π are made transparent. The regions in the aperture whose point sources produce a wave at the focal point with phase between π and 2π are made opaque.

FIGS. 2*a* and 2*b* are diagrams of the reflection and folded Fresnel zone plate configurations. The reflection zone plate is made by replacing the opaque rings with reflective rings resulting in a focal point on the incident wave side of the zone plate. In the folded zone plate configuration, a solid reflector is placed a quarter wavelength behind the reflective rings. Thus the regions of the incident wave which were discarded because they would contribute a signal with phase between π and 2π at the focal point undergo a π phase shift die to the half wavelength extra path, and now they contribute a signal with phase between 0 and π or at the focal point.

DETAILED DESCRIPTION OF THE PREFERRED EMBODIMENT

Figure 3:
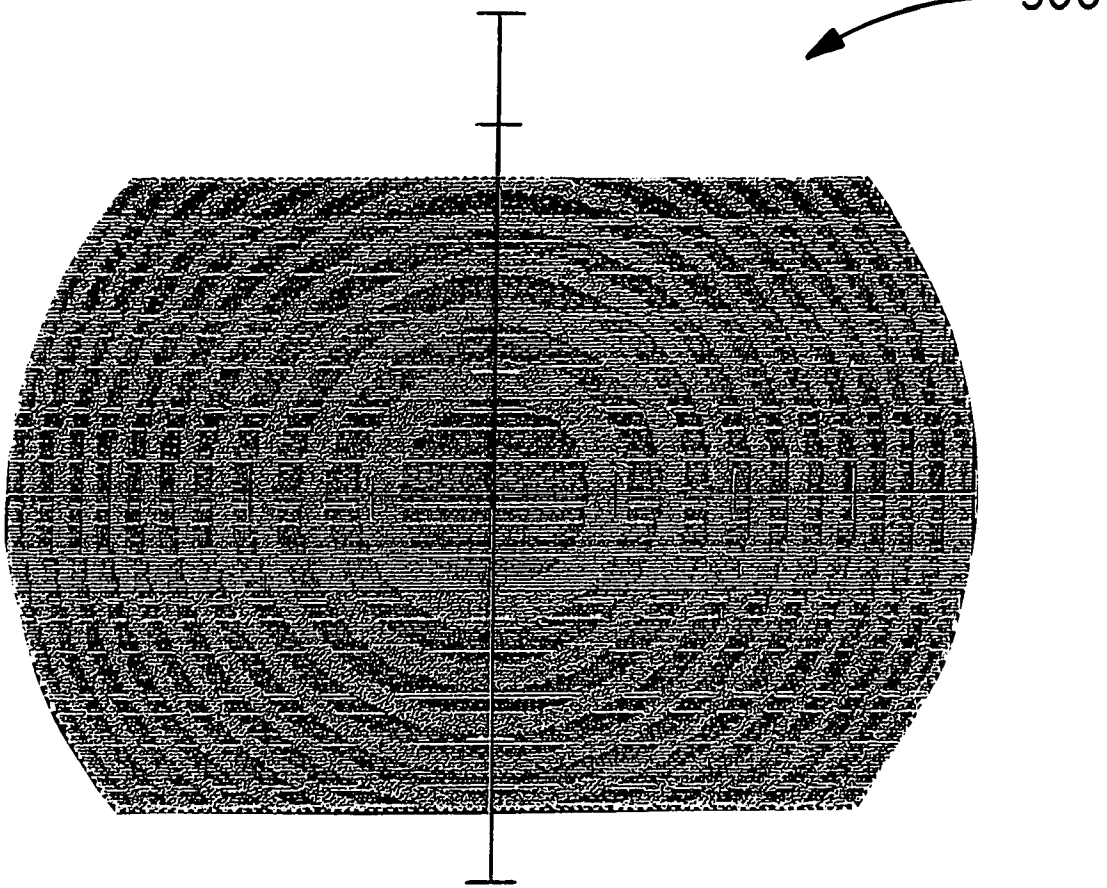
FIGS. 3–5 show zone plate ring configurations: 300, 400, and 500 respectively

The present invention includes a use of reconfigured antennas using microelectrical mechanical (MEMs) shutters. As mentioned above, the invention makes use of three related, but distinct ideas. Two are classes of reconfigurable antennas constructed with the aid of MEMs shutters. The first class is the Fresnel zone plate antenna which can be electronically reconfigured to point the main beam over a useful range of pointing directions. The second class is integrated circuit antennas constructed on dielectric substrates, such as the microstrip patch antenna and printed dipole antenna, which can be electronically reconfigured to operate over very wide bandwidths, either as isolated elements or in the array. The third idea is a technique to form multiple beams complete with null formation capability from a zone plate or reflect-array antenna.

The Fresnel zone plate is an optical device that has the ability to focus a planar electromagnetic wave. It is formed by constructing a series of concentric circles whose radii are roughly proportional to the square root of the natural numbers, i.e., $r_1 \sim \sqrt{1}$, $r_2 \sim \sqrt{2}$, $r_3 \sim \sqrt{3}$, etc. This approximation is valid when the focal length of the device is much longer than the wave length of operation which is generally true in the optical region. Alternating rings are made opaque so that the zone plate operates by allowing incident rays that add constructively at the focal point to pass through the zone plate and blocking incident rays that would add destructively. A diagram of the zone plate is shown in FIG. 1*a* and FIG. 1*b*.

FIGS. 1*a* and 1*b* show front and side views of a conventional Fresnel zone plate, transmission reconfiguration. The ring pattern is designed by simple geometry. Using Huygen's principle the incident plane wave is replaced by point sources in the zone plate aperture. The regions in the aperture whose point sources produce a wave at the focal point with phase between, say, 0 and π are made transparent. The regions in the aperture whose point sources produce a wave at the focal point with phase between π and 2π are made opaque.

The above-cited Collinge patent shows the use of a zone plate for focusing microwave energy and in particular to a phase correcting reflection zone plate for focusing microwaves. This invention also relates to apparatus and a method for manufacturing such a zone plate.

The use of zone plates for focusing microwaves is well known. One particular type of zone plate disclosed in "Millimeter-Wave Characteristics of Phase-Correcting Fresnel Zone Plates" by D. N. Black and J. Wiltse, IEEE Transactions on Microwave Theory and Technique Volume 35 No. 12 (1987) Page 1122–1128, is the phase-correcting Fresnel zone plate. Such a zone plate is used for quarter wave correction, although a phase correcting zone plate can be made for any wavelength fraction. The radius of each zone $r_n$ can be given by $$r_n = \left(\frac{2nf\pi}{P} - \left(\frac{n\lambda}{P}\right)^2\right)^{\frac{1}{2}}$$

where n is the zone number, f is the focal length, λ is the wavelength of the radiation and P is an integer greater than 2. For quarter wave correction P=4. For such a zone plate both in and out of phase zones contribute to the efficiency compared to a conventional zone plate. The correction of the phase of the zones is reflected from that zone. Thus the energy reflected from the zone 2*a* of the quarter wave zone plate of FIG. 1 would be out of phase with respect to the energy from the zone 3 by $$\frac{\lambda}{4}$$

at the focus, unless the pathlength was decreased or increased by $$\frac{\lambda}{4}.$$

An increase in the pathlength of $$\frac{\lambda}{4}$$

is achieved by providing steps $$\frac{\lambda}{8}$$

in depth. Thus the zone 2*a* is $$\frac{\lambda}{8}$$

higher than zone 3 and zone 2*b* and 2*c* are $$\frac{\lambda}{4}$$

and $$\frac{3\lambda}{8}$$

higher than zone 3 respectively. More generally, the different phases of the zones are stepped by d where $$d = \frac{\lambda o}{2P}$$

where λo is the free space wavelength of the radiation. The construction of such a zone plate may be achieved by a number of manufacturing processes such as machining out of solid metal, stamping out of a thin metal sheet, moulding and subsequently metallising a plastic material or by vacuum forming plastics.

In the zone plate of FIG. 1*a*, only the portion of the incident plane wave which adds constructively at the focal point is allowed to pass. The portions that would add destructively are reflected away.

FIG. 1 shows a transmission zone plate, ie., the incident wave passes through the zone plate to the focal point. However, the other configurations are possible as shown in FIGS. 2*a* and 2*b*. The opaque rings in the transmission zone plate can be replaced by reflective rings. By the same geometric argument given above, the reflective portion of the wave will add constructively at a focal point on the same side of the zone plate as the incident wave. This configuration is referred to as the reflection zone plate. It is evident that the reflection zone forms two focal points, and most practical applications require only one. It is possible to fold the second focal point onto the first by placing a solid reflector a quarter wavelength behind the zone plate, thus boosting the efficiency by a factor of two. This configuration is called the folded zone plate and is shown in FIG. 2.

FIGS. 2*a* and 2*b* show the reflection and folded Fresnel zone plate configurations. The reflection zone plate is made by replacing the opaque rings with reflective rings resulting in a focal point on the incident wave side of the zone plate. In the folded zone plate configuration, a solid reflector is placed a quarter wavelength behind the reflective rings. Thus the regions of the incident wave which were discarded because they would contribute a signal with phase between π and 2π at the focal point undergo a π phase shift due to the half wavelength extra path, and now they contribute a signal with phase between 0 and π at the focal point.

The zone plates shown in FIGS. 2*a* and 2*b* use only one layer of rings. As described for FIG. 1, the rays arriving at the focal point have relative phase between, say, 0 and π. It is possible to decrease the spread in the phase over which the rays arrive at the focal point by increasing the number of layers of zone plate rings. If the number of layers of rings is increased to four, the relative phase of the arriving rays is between 0 and $$\frac{\pi}{2}.$$

This decrease in phase spread results in higher antenna efficiency. In the remainder of this disclosure, the discussion will generally center on one layer of rings for simplicity. However, the possibility of using more layers of rings is implied.

The zone plate can be used in microwave and millimeter wave regions of the spectrum as well. Further it can be adapted for use as an aperture antenna. The zone plate is a quasi-optical wave region, and it can be used to construct lenses and reflector antennas. A feed antenna can be placed at the focal point of the zone plate to form a prime focus antenna, or subreflectors can be used to form center fed or off axis designs.

Figure 4:
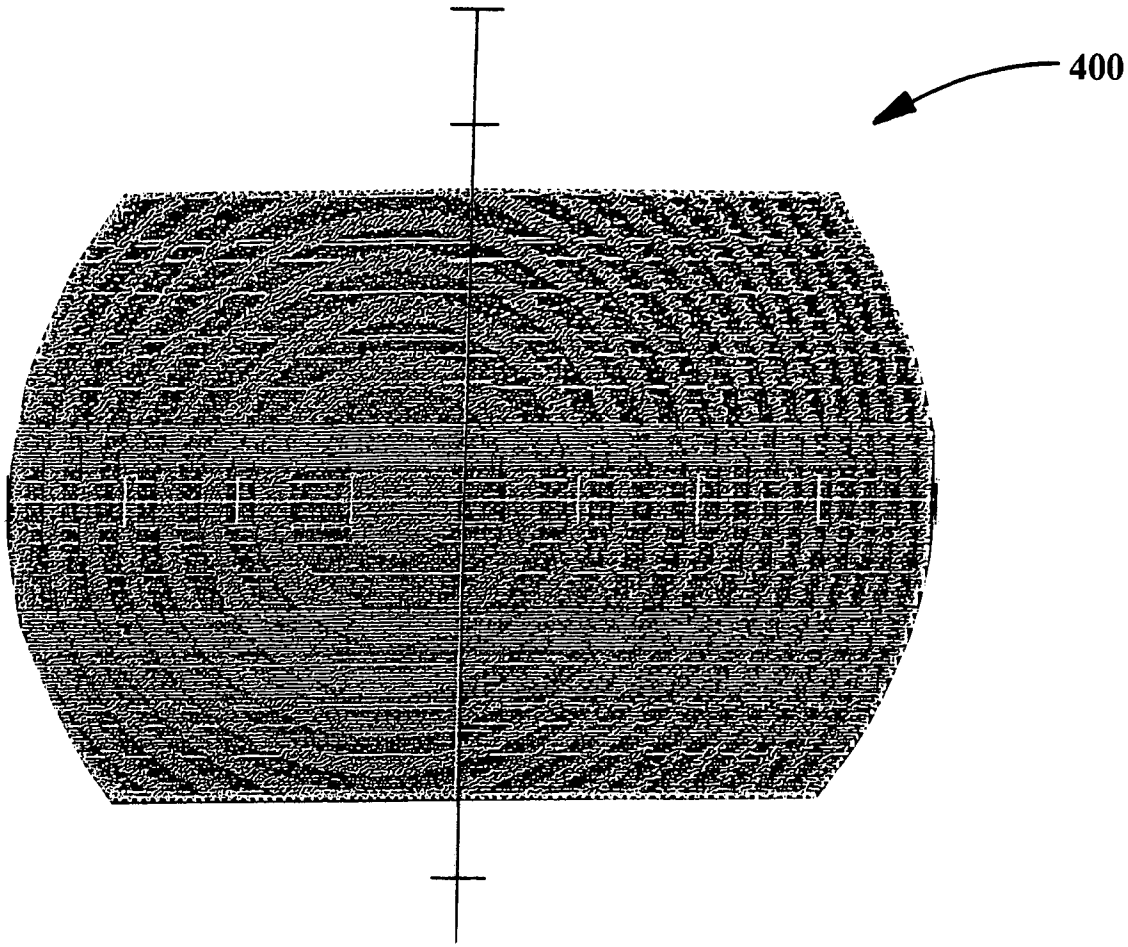
Figure 5:
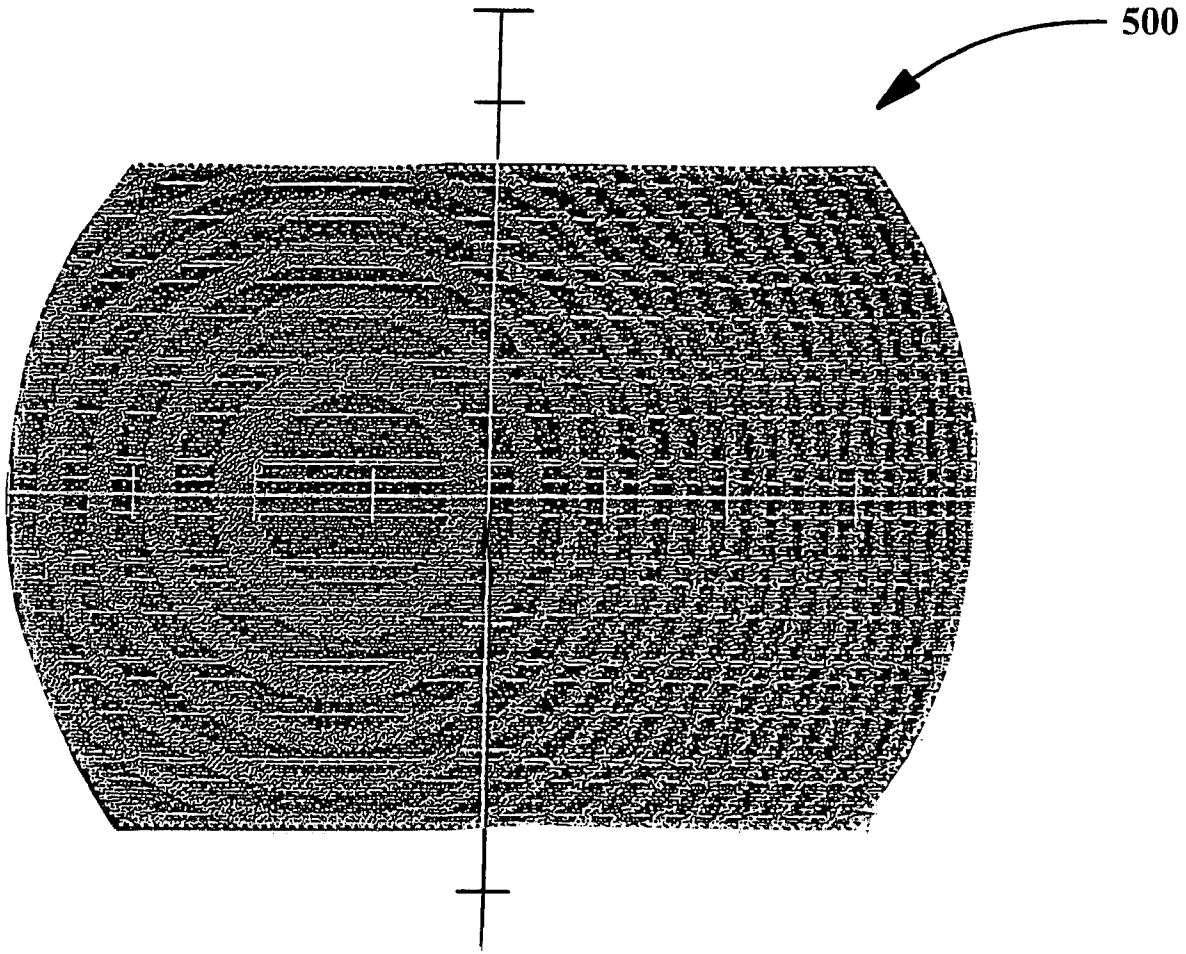

The new concept proposed here is to make the main beam from the zone plate antenna able to scan electronically over a useful range of directions. The advancement over previous devices comes from the incorporation of the MEMs shutter arrays as the mechanism to re-write the zone plate rings and thus redirect the pointing angle of the antenna. FIGS. 3–5 show the zone plate ring configurations for a 20 cm by 13 cm reflector designed for operation at 76.5 GHz steered to 0°, 8°, and 16°, respectively. The particular application in these figures is for automotive crash avoidance or automatic cruise control radar, but they serve to illustrate the concept of reconfiguration which will have application to communication systems and other types of radar. This device is particularly well suited for the millimeter and sub-millimeter wave regions. Conventional phase arrays become increasingly difficult to construct at higher frequencies. In addition the smaller apertures typically required at these frequencies make the shutter array realizable in a reasonable time frame.

Reconfigurable MEMs systems such as the one in the above-cited Bozler patent are used to form a MEMs shutter array to form zone rings which act as a Fresnel zone plate antenna as shown in the Collinge patent, and as described below.

The feed antenna and/or subreflector will be a critical element in the efficient realization of these electronically steered antennas. It is conceivable that the subreflector might also be reconfigured as the beam is steered to larger angles. A MEMs shutter array may be applicable for this device as well.

The concept of a flat structure, constructed with the appropriate details, used to replace the curved "dish" in traditional reflector antennas and possessing the ability to electronically re-direct the beam has been known for many decades. These structures are usually called reflect-arrays. These rely on an array of antennas which receive the incoming wave and reradiate it with the appropriate phase delay. The signal is received by the antenna; it travels down a length of transmission line whose length can be adjusted; it reflects from an open or short circuit; and it is reradiated from the antenna. The amount of phase shift introduced at each element is determined by geometry in a manner similar to the zone plate antenna. Reflect-arrays have been constructed with waveguide antennas or in planar configurations using microstrip patch or strip dipole antennas.

The reconfigurable zone plate described here is different from the reflect-array because it is based on the reflection of the incident wave from a metal sheet rather than reradiation from antennas. Compared to the reflect-array, the electrical performance of the reconfigurable zone plate antenna should be as good or better in the millimeter-wave region and significantly better in the sub-millimeter wave region. This performance advantage arises because simple reflection from metallic surfaces is more efficient than signals traveling through a transmission line based variable phase shifter. In addition, the technique described here has the potential for considerably lower cost because the MEMs shutter on which it is based is being considered for transition to silicon IC foundry manufacturing.

Electronically directed antennas based on the Fresnel zone plate should have application to many aspects of radar and communication engineering. In particular this technique is well suited to automotive crash avoidance and automatic cruise control radars. It has a significant advantage over the mechanically steered antennas currently being considered. It will be capable of more rapid reconfiguration which will become important as these automotive systems become more complex in the future. The MEMs shutter based zone plate antenna also has a bandwidth advantage over the conventional reflect array approaches. The zone plate can be configured to operate over a wide bandwidth. The zone plate bandwidth will be limited by the feed antenna (could be a horn with near octave bandwidth) where as the planar microstrip patch and strip dipole arrays are limited in bandwidth to the array element (~10 to 20%). The instantaneous bandwidth or the zone plate is limited by the geometry used to define the rings, but it is comparable to planar reflect-arrays at 10–20%.

It is generally acknowledged that the high cost of planar, electronically scanned antennas is the obstacle to widespread use. Some current and potential applications of low cost electronically scanned antennas include: communications on the move to satellite sources, stationary users to LEO satellites (Teledesic), Local Multi-point Distribution (both users receiving signals from multiple base stations or base station transmission to multiple users), automotive and Intelligent Highway Vehicle Systems, and military communications and radar.

A variation of the Fresnel zone plate antenna is to integrate both the zone plate and the feed antenna on to a single dielectric substrate. While this configuration has not seen much application, it has potential advantages of system miniaturization and higher levels integration. An integrated circuit antenna is used for the feed, and, thus, could be integrated with the signal detection and processing circuitry. An example of a convention integrated circuit Fresnel zone plate antenna is shown in the Collinge patent.

In a similar manner to that described above, the integrated circuit Fresnel zone plate antenna could be steered electronically by using a MEMs shutter array to form the zone plate rings. This configuration could have application to electronically scan millimeter-wave imaging arrays.

The concepts described in this section are techniques to provide more functionality to the reconfigurable zone plate antenna. While these ideas are particularly well suited to the zone plate antenna, they are also applicable to the reflect-array described above. The discussion below will use the reconfigurable zone plate antenna as the example case.

Another interesting possibility is to use the reconfiguration potential to form multiple simultaneous beams. This may be useful for expanding the beamwidth of the antenna in search mode of a radar or for forming nulls in the antenna pattern. Continuing with the automotive radar example given above, suppose one wanted to form an 18 degree beamwidth. The traditional technique to form a broader beam is to make the aperture more narrow. For this case the width of the zone plate would need to be 1.5 cm. While it is possible to maintain the center 1.5 cm of the zone plate and set the other shutters to a pattern that randomly scatters the beam, the efficiency of the antenna would be severely degraded since most of the energy from the feed would illuminate portions of zone plate aperture (20 cm wide) that do not help form the beam.

The solution to this problem is to form several beams, each pointing in a slightly different direction. One example is the zone plate aperture is divided into five separate regions. The center three, 5 cm in width each, are used to form three beams. The 5 cm aperture results in a beam approximately 6 degrees wide. The left beam is steered to −6 degrees (covers −9 to −3 degrees). The center beam is steered to 0 degrees (covers −3 to +3 degrees). The right beam is steered to +6 degrees (covers +3 to +9 degrees). The left most and right most regions are set to randomly scatter the beam. The aggregate beam covers −9 to +9 degrees. It should be noted that antenna patterns other than those with a more or less uniform gain over a continuous solid angle are possible. Antenna patterns with several main lobes having varying beamwidths and gains can be formed in independent directions.

This concept can be extended to form nulls in the radiation pattern of the zone plate antenna at desired angles. The formation of nulls is analogous to null formation in a multibeam antenna. To form nulls it must be possible to change the phase and amplitude of the signal received from each beam. The amplitude of the signal can be controlled by setting the appropriate number of shutters to randomly scatter the beam. The phase of the received signal can be set by adjusting the radii that defines the regions between shutters states. The amount of control over the phase is a function of the number of ring layers in the zone plate.

A simple example of how the phase can be changed will help illustrate the point. In the single ring-layer zone plate the difference in phase of the arriving ray reflected from an open or closed shutter is $\pi$ radians. If the state of every shutter were switched, open to closed and vice versa, the phase of the total beam would switch by $\pi$. If the desired phase shift was $$\frac{\pi}{2}$$

radians, approximately half the shutters would have to change state. The location of these shutters is near the ring boundaries, having the overall effect of shifting the radii of these rings.

A significant difference between a true multiple beam antenna (MBA) and one implemented with the reconfigurable zone plate is that the output of each beam is accessible in the true MBA where only the sum beam is available in the zone plate version. The outputs of the individual beams are often put to use, for example in determining the spatial direction of an unwanted jamming signal.

Since the zone plate simply replaces the main reflector, a conventional reflector antenna, a monopulse feed can be used for efficient direction finding. However, it is also possible to enact a quasi-monopulse scheme using the reconfigurable zone plate antenna and a simple feed antenna. The relative ease of this technique relies on forming a difference pattern with the reconfigurable zone plate antenna. For a single beam steered broadside, the zone plate ring has a ring pattern consisting of concentric rings. If all the shutters on one side of the zone plate were changed in state, open to closed and vice versa, a difference pattern would result since the contribution of the two halves are equal in magnitude and opposite in phase. It is straightforward to configure difference patterns to steer angles other than broadside. By alternating between sum, azimuth difference and elevation difference, one can perform direction finding.

While it is clear that a reconfigurable zone plate antenna will not have the ultimate performance of a conventional phased array or multiple beam antenna, it is capable of providing a significant subset of the functionality usually found only in these more sophisticated antennas. Some of these functions include: electronic beam steering, variable beamwidth patterns, multiple simultaneous beam generation, pattern nulling, and direction finding.

A major difference between the reconfigurable zone plate antenna and a phased array or MBA is that the zone plate antenna has a single feed. This means only a single low noise amplifier and/or power amplifier is needed where the other antennas need amplifiers and phase shifters at every element. The single feed is a distinct advantage for producing a low cost antenna since the active devices are generally one of the cost drivers. The single feed, however, is also a limiting factor in the electrical performance since having access to the outputs of the elements in the array enables more sophisticated processing of the received signals, e.g. the MBA nulling example.

There are two ways the MEMs shutters can be used in integrated circuit antennas. Both are intended to make the antenna capable of reconfiguring for operation over a wide bandwidth. The first and most straightforward is to use the shutter array to change the dimensions of the antenna and thus change its resonant frequency. The second and more interesting possibility is to construct a multi-layer circuit board with both reconfigurable antennas and feed network. This will allow an antenna array to operate without grating lobes over an octave or more of bandwidth.

Changing the physical size of the antenna to change its resonant frequency is a fairly straight forward application of MEMs switches. Similar schemes have been employed using photoconductive diodes and superconducting switches. It is very likely that patent applications have been made in this area. However, the novel aspect of about using these particular MEMs shutters for the switch is that the relatively large shutters roll up away from the antenna so they have much lower impact than other MEMs switches on the current distribution on the antenna and the fields radiated from it. One drawback to the shutters is their thin metalization (necessary for the rolling action). This gives rise to conductor losses. A way around this drawback is to have regions of permanent metalization (with appropriate thickness) and use the shutter to close the connection between the desired metal patterns. The dedicated metal patterns can be chosen for the high current regions, thus reducing loss. See FIG. 6.

FIG. 6 shows a scheme for adjusting the physical size of the patch antenna which permits wide bandwidth operation. Other antenna and feeding configurations are possible. It may be necessary to construct a number of dedicated metal regions with thicker metal to reduce the conductor losses shown in (b).

Figure 6B:
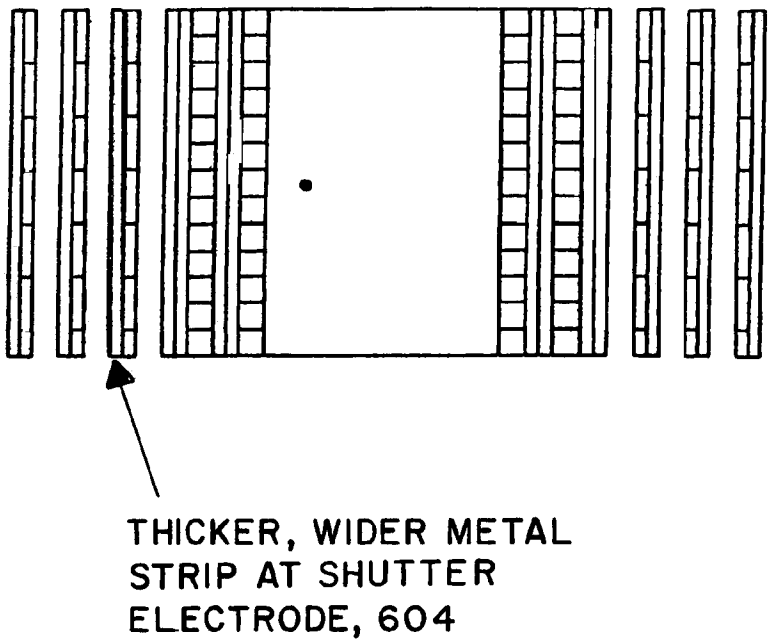
FIGS. 6*a*, 6*b*, and FIGS. 7*a*–7*c* show shutters used with a microstrip patch antenna array and feed network.
Figure 6A:
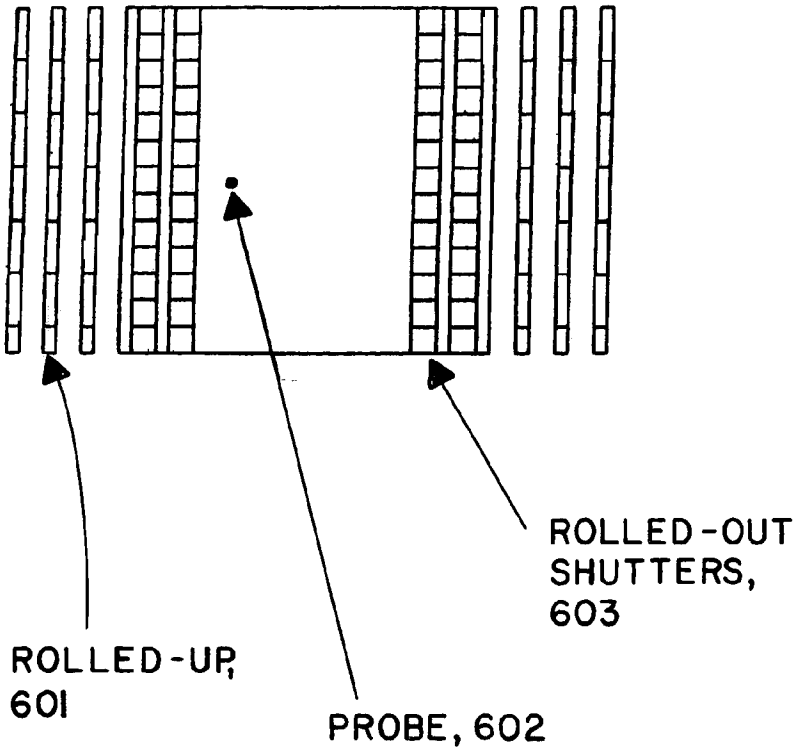

FIGS. 6*a* and 6*b* depict the shutters for use on a microstrip patch antenna; however, a variety of integrated circuit antennas are suitable for reconfiguration. Strip dipoles and slot antennas are especially good candidates. These antennas could be used as isolated elements or in an array with a standard feed to achieve moderate bandwidth performance.

A variation on this idea is to use the shutter to change the radiation properties of the antenna. For example, a circularly polarized patch antenna can be created by modifying the geometry of two diagonal corners of the patch. The MEMs shutters could be used to switch in and out of this modification so that the polarization can be switched between left-hand and right-hand circular.

The most difficult aspect of designing a broad bandwidth antenna array is reconciling the conflicting demands of placing the array elements close enough at the highest frequency of operation to avoid producing grating lobes and spacing the elements far enough apart at the lowest frequencies of operation so an efficient radiating element can be used. In a nominal phased array that steers the beam to +/−60 degrees, the spacing between elements must be about ½ of the free-space wavelength to avoid grating lobes. Thus the highest frequency of operation often determines the spacing between elements in an array. If it is desired that the array operate over an octave bandwidth, the spacing between elements will be ¼ of a free-space wavelength at the lowest frequency of operation. This is generally not enough room to construct an efficient radiating element that will operate over the octave bandwidth.

Figure 7A:
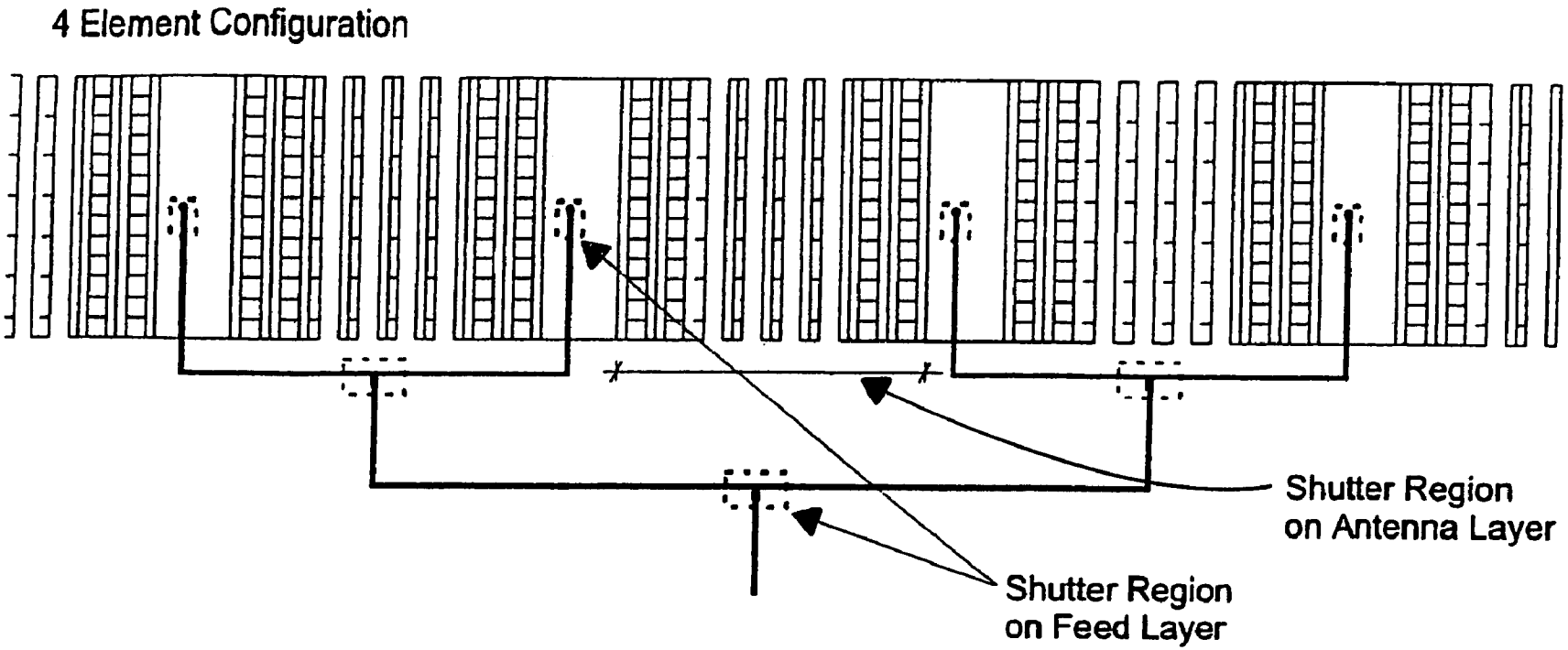
Figure 7B:
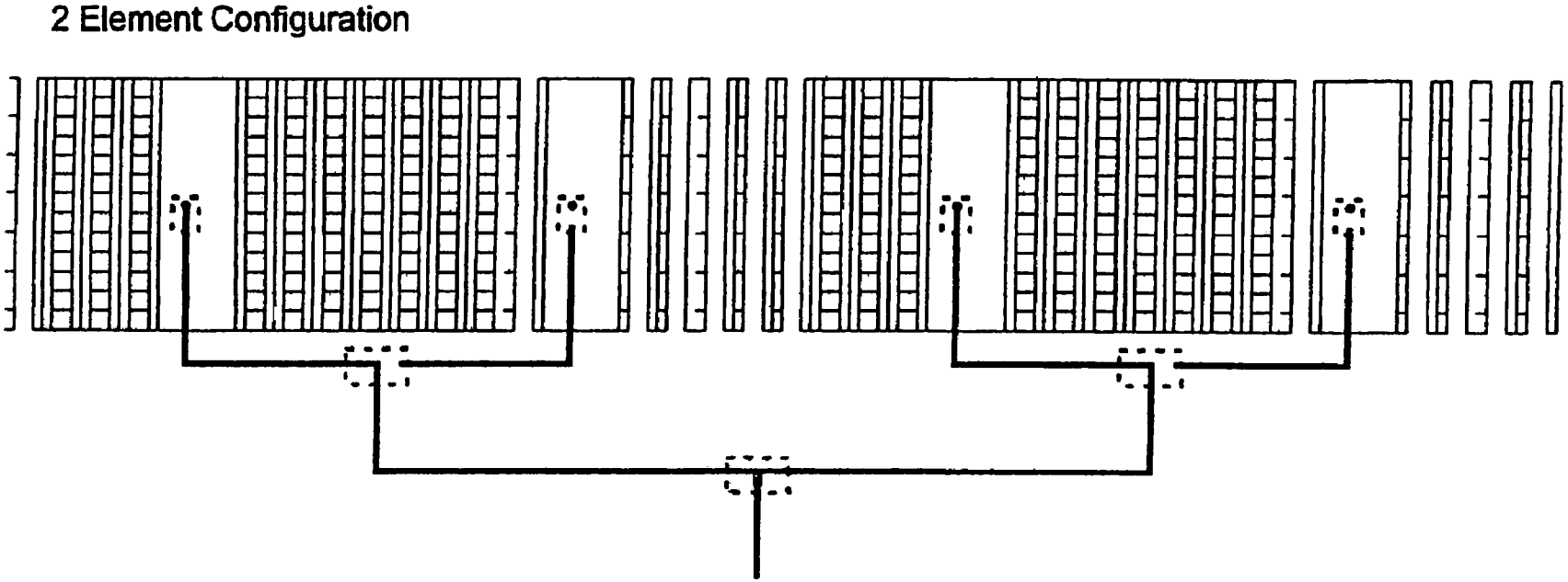
Figure 7C:
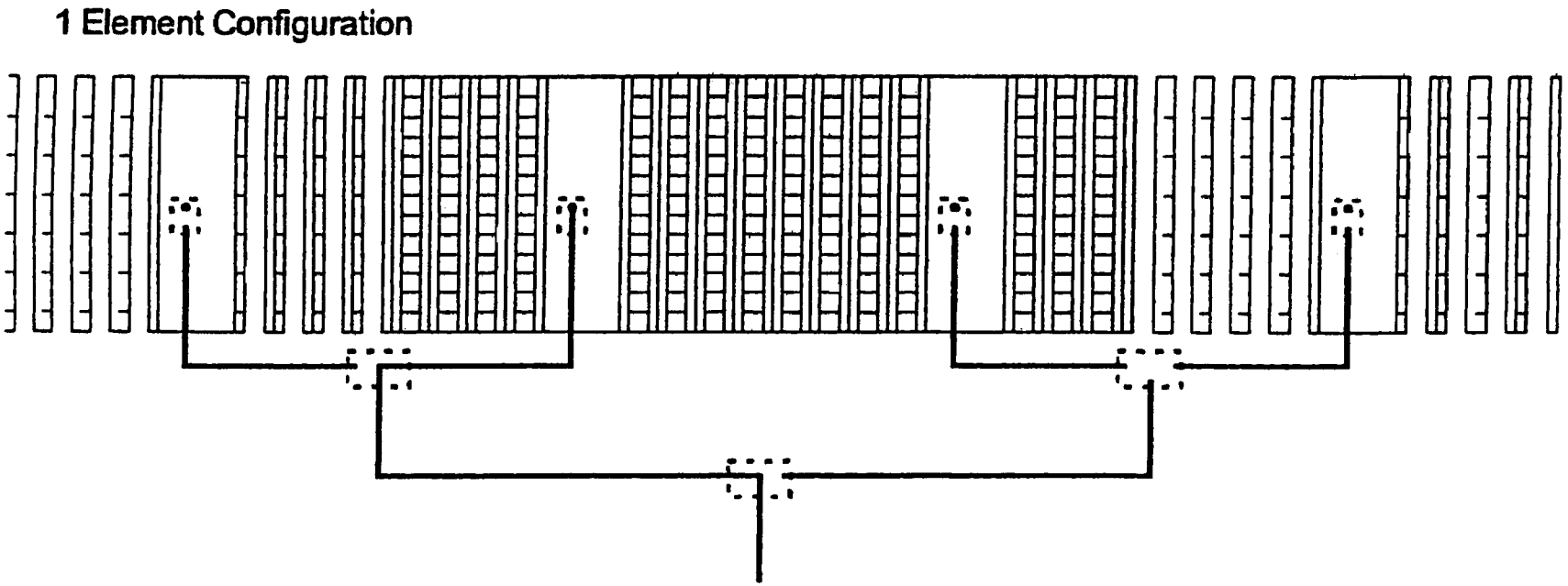

The reconfigurable shutter array offers a solution to this dilemma by providing the ability to change not only the size of the radiating elements for efficient operation but also providing the ability to change the number of radiation elements in the array by reconfiguring the feed network. The concept is shown in FIGS. 7*a*–7*c*. The antenna array contains at least two layers. The top layer has the shutter and metal regions that defined the patch antennas. Unlike the antennas in FIG. 6, the antenna layer in this concept is a nearly continuous sheet of shutter and dedicated metal regions which can be reconfigured to form widely different size radiating elements. The bottom layer has the feed network which also contains shutter arrays at strategic points so that the feed structure and impedance matching circuit at each antenna feed can be reconfigured. The connection from feed layer to the antenna layer is shown as a probe feed; however, other connection schemes are possible. Aperture coupling might be a good choice since it does not protrude into the antenna layer, permitting a greater number of feed locations for increased flexibility. With aperture coupling, it should be possible to feed even in the shutter regions. This is not possible with probe feeding. The figure shows the antenna elements only growing in one dimension as the frequency is decreased, but they could be configured to grow in two dimensions which would keep the antenna impedance more constant over frequency.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A reconfigurable reflect array consisting of:

a. a reflect array constructed so that the phase change of the signal after reflection from an element in the array is adjusted over a range of 0–2π;

b. a means to address the elements in the array either individually or in groups; and c. a processor to orchestrate the phase shift settings of the elements to achieve a focusing of the incident wave.

2. A reconfigurable reflect antenna consisting of:

a. a reconfigurable reflect array;

b. a transmitting and/or receiving antenna element used as feed; and c. an array element control means to form a single beam with reconfigurable pointing directions.

* * * * *